US009359118B2

(12) United States Patent
Nilsson et al.

(10) Patent No.: US 9,359,118 B2
(45) Date of Patent: Jun. 7, 2016

(54) PACKAGING MATERIAL COMPRISING MAGNETISABLE PORTIONS

(75) Inventors: Tommy Nilsson, Eslöv (SE); Lars Bergholtz, Höganäs (SE); Ann-Charlotte Klint, Löddeköpinge (SE)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 24 days.

(21) Appl. No.: 13/322,604

(22) PCT Filed: May 11, 2010

(86) PCT No.: PCT/SE2010/000133

§ 371 (c)(1),
(2), (4) Date: Nov. 28, 2011

(87) PCT Pub. No.: WO2010/138055

PCT Pub. Date: Dec. 2, 2010

(65) Prior Publication Data

US 2012/0070633 A1 Mar. 22, 2012

(30) Foreign Application Priority Data

May 29, 2009 (SE) ..... 0900732

(51) Int. Cl.

| | |
|---|---|
| ***B65D 65/38*** | (2006.01) |
| ***B31B 1/74*** | (2006.01) |
| ***B31B 1/88*** | (2006.01) |
| ***B65B 9/20*** | (2012.01) |
| ***B65B 61/02*** | (2006.01) |

(52) U.S. Cl.

CPC . *B65D 65/38* (2013.01); *B31B 1/74* (2013.01); *B31B 1/88* (2013.01); *B65B 9/20* (2013.01); *B65B 61/02* (2013.01); *B31B 2201/88* (2013.01); *B31B 2201/95* (2013.01); *B65D 2203/00* (2013.01); *Y10T 428/24802* (2015.01)

(58) Field of Classification Search

USPC ..... 428/35.7; 324/207.21, 207.12

See application file for complete search history.

(56) References Cited

U.S. PATENT DOCUMENTS

| | | | |
|---|---|---|---|
| 3,237,973 | A | 3/1966 | Rumberger |
| 7,839,140 | B2 | 11/2010 | Holmstrom |

(Continued)

FOREIGN PATENT DOCUMENTS

| | | | |
|---|---|---|---|
| EP | 0 705 759 | A1 | 4/1996 |
| EP | 1172299 | A1 | 1/2002 |

(Continued)

OTHER PUBLICATIONS

International Search Report (PCT/ISA/210) issued on Aug. 6, 2010, by Swedish Patent Office as the International Searching Authority for International Application No. PCT/SE2010/000133.

*Primary Examiner* — Ellen S Wood

(74) *Attorney, Agent, or Firm* — Buchanan, Ingersoll & Rooney PC

(57) ABSTRACT

A packaging material comprising a plurality of magnetisable portions thereon comprising at least one spot per package to be formed from the packaging material is disclosed. At least one of the magnetisable portions provides a first magnetic mark carrying a magnetic field pattern providing position information related to finishing of respective package to be formed.

16 Claims, 1 Drawing Sheet

(56) References Cited

U.S. PATENT DOCUMENTS

| | | | |
|---|---|---|---|
| 7,958,694 | B2 | 6/2011 | Johansson et al. |
| 2008/0309327 | A1 | 12/2008 | Holmstrom |
| 2009/0266034 | A1 | 10/2009 | Rosberg et al. |
| 2010/0016137 | A1 | 1/2010 | Benedetti et al. |
| 2012/0067953 | A1 | 3/2012 | Nilsson et al. |
| 2012/0070634 | A1 | 3/2012 | Holmström |
| 2012/0070638 | A1 | 3/2012 | Nilsson et al. |
| 2012/0073242 | A1 | 3/2012 | Nilsson et al. |
| 2012/0074234 | A1 | 3/2012 | Nilsson et al. |
| 2012/0076995 | A1 | 3/2012 | Nilsson et al. |
| 2012/0077001 | A1 | 3/2012 | Klint et al. |

FOREIGN PATENT DOCUMENTS

| | | | |
|---|---|---|---|
| EP | 1 914 168 | A1 | 4/2008 |
| JP | 07-010108 | A | 1/1995 |
| JP | 2005-525253 | A | 8/2005 |
| JP | 2008-532039 | A | 8/2008 |
| WO | WO 2006/073339 | A1 | 7/2006 |
| WO | WO 2006/093449 | A1 | 9/2006 |
| WO | WO 2006/135313 | A1 | 12/2006 |
| WO | 2008/046896 | A1 | 4/2008 |

PACKAGING MATERIAL COMPRISING MAGNETISABLE PORTIONS

TECHNICAL FIELD

The present invention relates to a packaging material comprising magnetisable portions, wherein the material is intended for forming e.g. food packages.

BACKGROUND

Within packaging technology where a packaging container is formed from a packaging laminate, it is known to provide the packaging laminate as a web which prior or during packaging is formed to the packaging container. Guiding marks, e.g. for optical reading has been provided to guide operations when finishing the package, such as forming, sealing, folding, etc. Such guiding marks are sometimes referred to as register marks. The register mark for optical reading is provided during printing of the packing laminate, where e.g. decoration or product information is printed on the packaging laminate. A problem with such register marks is that they consume a non-negligible area of what becomes the exterior of the package. A further problem is that such a register mark has to rely on the printing being well aligned with other operations performed on the web. It is therefore a desire to provide an improved provision of marking of web of packaging laminate.

SUMMARY

The present invention is based on the understanding that magnetic marking can be provided on a packaging laminate. Storing information in a magnetic recording medium in packing material has been suggested in e.g. EP 705759 A1. In the present disclosure, it is suggested that one or more spots per intended package to be formed from the web is provided on the web, wherein the spots comprises magnetisable particles such that magnetic marking is enabled.

According to a first aspect, there is provided a packaging material comprising a plurality of magnetisable portions thereon comprising at least one spot per package to be formed from the packaging material, wherein at least one of the magnetisable portions provides a first magnetic mark carrying a magnetic field pattern.

The magnetic pattern of the first magnetic mark may be representing complex data. The material may define a transversal direction being parallel to an imaginary axis of a roll when a web of the material is spooled, and a longitudinal direction perpendicular to the transversal direction, wherein the magnetisable portion providing the first magnetic mark may comprise a strip essentially along the longitudinal direction of the web. The complex data may hold information from which the material can be uniquely identified, preferably information from which a part of the material where the magnetisable portion providing the magnetic mark is present can be uniquely identified. The complex data may be represented as a modulating scheme of the magnetic field of the magnetic pattern, wherein the modulating scheme may comprise any of a group comprising phase shift keying, frequency shift keying, amplitude shift keying, quadrature amplitude modulation, and pulse width modulation.

At least one of the magnetisable portions may provide a second magnetic mark carrying a magnetic field pattern aligned with at least one preparation feature for enhancing finishing of packages. The preparation feature may comprise any of a group comprising crease lines, openings, perforations, package boundary or sealing, beginning of web, end of web, positioning of optical mark, print for package outside. A distance between an area of a preparation feature and its aligned magnetic field mark may be at least 2 mm, preferably at least 5 mm, preferably at least 7 mm, preferably at least 10 mm.

At least one of the spots for each package to be formed may be positioned not more than 20%, preferably between 5 and 15% of the width of the material to form a package from a longitudinal edge of the material to form the package.

The magnetic field pattern may comprises at least a first magnetic field peak having a first polarity and a second magnetic field peak having a second opposite polarity. The material may define a transversal direction being parallel to an imaginary axis of a roll when a web of the material is spooled, a longitudinal direction perpendicular to the transversal direction, and an imaginary line between a midpoint of the first peak and the second peak of the magnetic field pattern, wherein the magnetic field pattern may be arranged such that the angle between the imaginary line and the longitudinal direction is between −10 and 10 degrees, preferably between −5 and 5 degrees, preferably about 0 degrees. The peaks of the magnetic pattern may have a distribution forming a substantially constant magnetic field along a width of the magnetic pattern in a direction perpendicular to the imaginary line, and forming a strongly decreasing magnetic field outside the width of the magnetic pattern in the direction perpendicular to the imaginary line. The width may be at least 2 mm, preferably at least 4 mm, preferably at least 6 mm.

DETAILED DESCRIPTION

Figure 1:
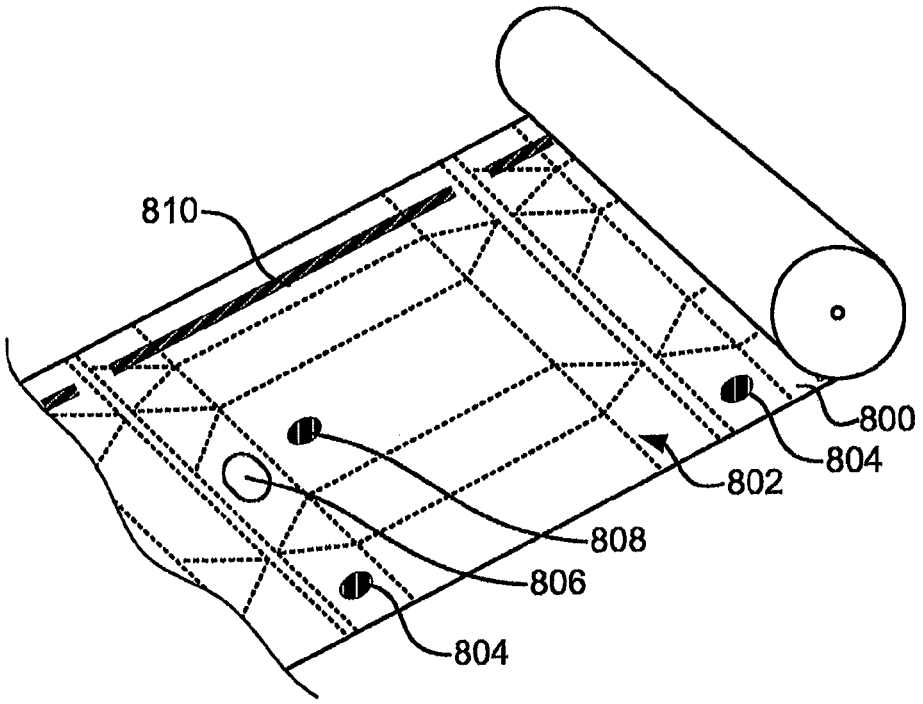
FIG. 1 schematically illustrates a web of packaging laminate according to an embodiment.

A web of packaging material, such as a laminate, comprises a plurality of magnetisable portions thereon, as illustrated in FIG. 1. The web comprises at least one spot per package to be formed from the packaging laminate. Further, at least one preparation feature for enhancing finishing of packages is provided by the web. The at least one preparation feature is aligned with a magnetic field mark in the at least one magnetisable portion. For example, as illustrated in FIG. 1, crease lines are made in the web for enabling a swift and reliable finishing of the package. Upon making the crease lines, a mark, formed as a predefined magnetic field, in the magnetisable portion simultaneously with the making of the crease lines. The mechanism for making the crease lines, i.e. rolls with patterned grooves/protrusions, can be provided with a magnetising element. The magnetic mark will then be ensured to be aligned with the crease line making operation. The magnetising element can be a permanent magnet, or an electromagnet, for providing the magnetic field mark. When the magnet provided at the periphery of a crease roll comes in close vicinity of the magnetisable portion, the magnetisable particles of the magnetisable portion will be magnetised, and a magnetic field pattern will remain at the magnetisable portion. Thus, a magnetic field mark is provided. Preferably, the magnetisable portion is slightly larger than the geometric size of the magnetic field mark, i.e. the part of the magnetisable portion having a remaining magnetism (remanence). Thereby, the alignment of the magnetisable portion is not crucial as the magnetic field mark will be the element providing an accurate position, and not the print of the magnetisable portion itself. By provision of a suitable magnetic pattern, the accurate magnetic field mark can also be accurately read, as will be discussed further below.

The preparation feature can be other than provision of crease lines, such as providing openings, perforations, etc. The alignment follows the same principle, i.e. that the magnetising portion is provided at the mechanism providing the preparation feature such that the alignment will be inherent because of the structure.

The application of the magnetising element in the mechanism performing the preparation feature may arise a few issues. The magnetising element may for example not be provided at a position where the preparation feature demands a mechanical interaction with the packaging laminate, such as forming a crease line or punching a hole. Therefore, there is preferably provided a distance between an area of such a preparation feature and its aligned magnetic field mark. Further, the tool performing the interaction as mentioned above may be made of a ferromagnetic material. To improve the application of the magnetic field mark, the magnetising element may need to be provided with a holding or mounting means made of a non-ferromagnetic material, such as aluminum, wherein the distance may be further increased. Thus, depending on the preparation feature operation, and the tool for performing it, the distance is preferably for example at least 2 mm, at least 5 mm, at least 7 mm, or at least 10 mm.

As several operations performing feature preparations, it is preferable that each such operation has its aligned magnetic field mark. Those different magnetic field marks are each preferably made in a respective magnetisable portion adapted in position for the operation. As some operations may be interacting, one operation can use a magnetic field mark made by another operation as a master mark, or there may be provided a certain dedicated master mark that is not inherently aligned with any feature preparating operation, which thus only is used for reference by later performed operations.

Other magnetic field marks may hold complex data, and can for example be provided as long rectangular spots, i.e. as strips. The strips can be provided along the entire web, with or without interruptions at parts intended to be cut upon finishing the packages. The magnetic field marks holding complex data can for example provide a unique code from which the web, and also the part of the web, can be identified. The complex data can also give position information, indications for the finishing of the package, etc.

FIG. 1 illustrates an example of a web 800 comprising crease lines 802 and a magnetisable portion 804 holding position information for the crease lines by an aligned magnetic field mark. The web 800 also comprises a punched hole 806 for each package to be formed, and a magnetisable portion 808 holding position information for the respective punched hole 806 by an aligned magnetic field mark. This magnetic field mark can for example be used upon moulding a re-closable opening on the package upon finishing. The web 800 also comprises a strip 810 holding complex data, for example as elucidated above.

A further position information can be package boundary or sealing, where an operation is for dividing the web into the parts forming the package, or for the sealing of respective package.

A further position information, that the magnetisable portion can hold, is magnetic position marks at ends of a web of the packaging material, i.e. beginning of web and/or end of web, such that, at splicing of the webs, the splice is enabled to be aligned.

A further position information is positioning of an optical mark, which may beneficial compatibility for packaging machines having either optical reading or magnetic reading of positioning information. Preferably, the position of the spot holding this information is positioned similar to the optical mark, but on the side that is intended to become the inside of the package. Since the optical marks normally is provided on the part intended to form the bottom of the package, the corresponding magnetisable portion is positioned accordingly. A magnetic mark at this magnetisable portion is thus enabled to provide the similar information as the optical mark, and the optical reader of a packaging machine can thus simply be replaced with a magnetic reader. In practise, no optical mark is thus necessary if the optical readers are replaced by magnetic readers, and the magnetic mark takes the place of the optical mark as described above. In that case, the compatibility lies in the sense of the same mounting position of the readers in the packaging machine.

A further position information can be for a print for the package outside. This position information can be beneficial for ensuring proper alignment of the print with the package, and with other feature preparations of the package.

Upon making the magnetic field mark, it can be beneficial that the means for writing the magnetic field mark, e.g. a permanent magnet or a electromagnet arrangement, has no or little relative movement, or at least an approximately constant relative movement to the magnetisable portion. This is achieved for example by integrating the writing means in e.g. rolls for making the crease lines, wherein there is no relative movement since the periphery of the rolls and the web moves by the same speed in the same direction. Another way of achieving no or little relative movement, or at least an approximately constant relative movement to the magnetisable portion is to control the movement at the position of the writing. This can be done by having a slacking portion of the web both before and after the writing position such that speed at this position can be controlled irrespective of the speed of the web before and after that position. The slack can be achieved by letting the web move along a wave-formed path where the sizes of the waves are adaptable to give a variable slack. Thus, during the writing operation, the speed can be controllable at the writing position, and the web is accelerated or decelerated between the writing operations to adapt to the average speed of the web.

Figure 2:
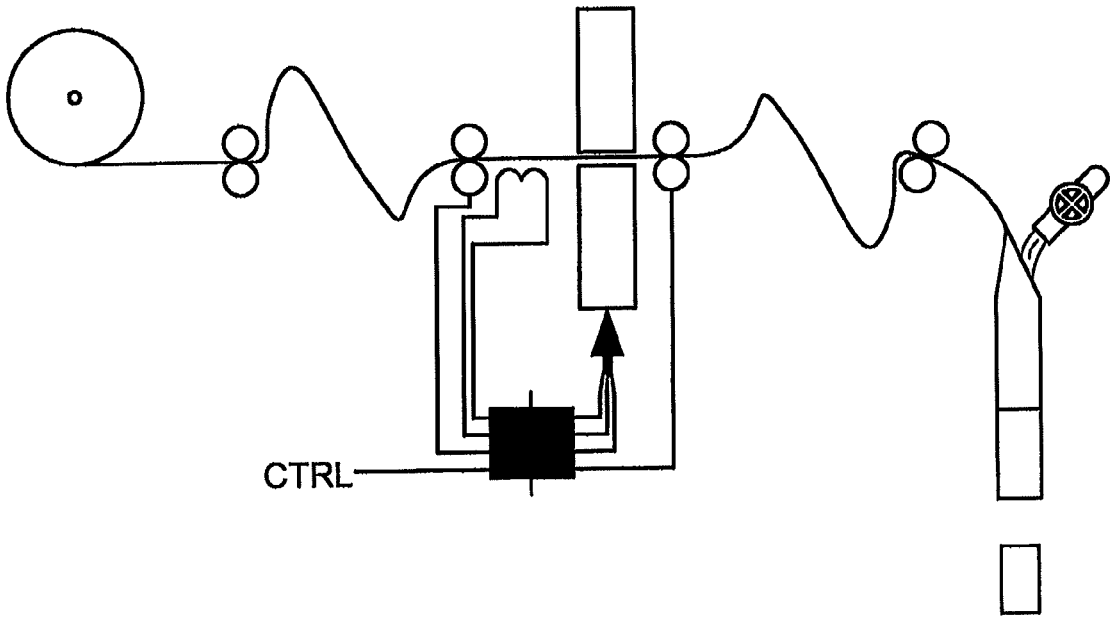
FIG. 2 schematically illustrates finishing of packages according to an embodiment.

The material is suitable for forming a tube to be sealed at one end, filled with content, scaled again to enclose the content, cut, and formed to a package, as schematically illustrated in FIG. 2. The magnetic mark has been found particularly suitable for solving a problem within that art. A magnetic mark is arranged such that any twist when forming the tube is enabled to be detected. By being able to detect any twist of the tube when making and filling the packages, which is performed at a high pace, a correction is enabled, which can greatly enhance operation and increase yield in terms of properly formed, filled and sealed packages.

The packaging operation as demonstrated above put certain demands on any additional operation. The inventors have found that it is a great benefit of being able to access the tube at the region of the joint of the edges of the packaging material. Therefore, at least one of the spots for each package to be formed, which then can be neatly used for determining of twist, is preferably positioned not more than 20% from the edges. Thereby, access is mostly enabled during operation of such packaging. For certain forms of packages within that art, it is preferable to have that spot between 5 and 15% of the width of the material from the edge.

A magnetic field mark at such spots can then be used for controlling twisting of the material when forming the package. The forming of the package is normally made by forming some kind of tube which then is sealed in some way at its ends and formed into the desired shape. The tube can then be unintentionally twisted, which can jeopardize the forming of the package. Therefore, such a magnetic field mark can help to control any twisting of the tube to ensure forming of the package. By having these magnetic marks relatively close to the longitudinal edges to be joined to form the tube, the control is further enhanced since the reading of the magnetic field marks can be made from the side of the package where the joining takes place.

The magnetic field pattern can comprise a first magnetic field peak having a first polarity and a second magnetic field peak having a second opposite polarity. Such a magnetic field pattern can be achieved by a single magnet, e.g. a permanent magnet having a north and a south pole, being arranged close to the magnetisable portion during application of the magnetic mark, such that the remaining magnetic field (remanence) of the magnetic particles of the magnetic ink of the magnetisable portion becomes as desired. The position in a longitudinal direction is then preferably detected by observing the shift of the magnetic field, e.g. zero-crossing, which can provide a very accurate position indication in the longitudinal direction. The position in a transversal direction is preferably detected by observing flanks of the magnetic field, e.g. by differential measurements technique, which will enable accurate tracking in the transversal direction.

The pattern illustrated is preferably aligned with the longitudinal or transversal direction. However, such a perfect alignment is not necessary. Considering an imaginary line between a midpoint of the first peak and the second peak of the magnetic field pattern, the magnetic field pattern can be arranged such that the angle between the imaginary line and e.g. the longitudinal direction is between −10 and 10 degrees. In a preferred embodiment, the angle is between −5 and 5 degrees. The peaks of the magnetic pattern can have a distribution forming a substantially constant magnetic field along a width of the magnetic pattern in a direction perpendicular to the imaginary line, and forming a strongly decreasing magnetic field outside the width of the magnetic pattern in the direction perpendicular to the imaginary line. The width is preferably at least 2 mm to enable detection of the flanks without interference. For higher reliability, the width is preferably at least 4 mm, and for some applications preferably at least 6 mm.

According to another embodiment of assignment of magnetic field pattern, the magnetic field pattern comprises a first magnetic field peak having a first polarity and a second magnetic field peak being distributed such that it encircles the first peak and having a second opposite polarity. Observing this magnetic field pattern in longitudinal and transversal directions will show the symmetric properties of the magnetic field pattern. Thus, detection according to the same principle can be made in any direction. For example, zero-crossings of the magnetic field can be observed using differential measurement technology. Another example is simply observing a main center peak of the magnetic field pattern.

The invention claimed is:

1. A web or sheetlike packaging material to be reformed into a tube to be sealed at one end, filled with content, sealed again to enclose the content, cut, and formed to a package, comprising a plurality of magnetisable portions thereon comprising at least one spot per package to be formed from the packaging material, wherein at least one of the magnetisable portions provides a first magnetic mark carrying a magnetic field pattern providing position information through which any twist of the formed tube is detected and corrected, wherein the magnetic field pattern comprises at least a first magnetic field peak having a first polarity and a second magnetic field peak having a second opposite polarity, a position of the formed tube in a longitudinal direction being detected by observing a shift of the magnetic field pattern.

2. The material according to claim 1, wherein said at least one of the magnetisable portions is a printed mark of a magnetisable ink comprising magnetisable particles.

3. The material according to claim 1, wherein said at least one of the magnetisable portions is positioned not more than 20% of the width of the material from a longitudinal edge of the packaging material, and wherein said at least one spot is arranged to hold the first magnetic mark.

4. The material according to claim 3, defining a transversal direction being parallel to an imaginary axis of a roll when a web of the material is spooled, and a longitudinal direction perpendicular to the transversal direction, wherein the magnetisable portion providing the first magnetic mark comprises a strip essentially along the longitudinal direction of the web.

5. The material according to claim 1, wherein at least one of the magnetisable portions provides a second magnetic mark carrying a magnetic field pattern aligned with at least one preparation feature for enhancing finishing of packages.

6. The material according to claim 5, wherein the preparation feature comprises any of a group comprising crease lines, openings, perforations, package boundary or sealing, beginning of web, end of web, positioning of optical mark, print for package outside.

7. The material according to claim 5, wherein a distance between an area of a preparation feature and its aligned magnetic field mark is at least 2 mm.

8. The material according to claim 7, defining a transversal direction being parallel to an imaginary axis of a roll when a web of the material is spooled, a longitudinal direction perpendicular to the transversal direction, and an imaginary line between a midpoint of the first peak and the second peak of the magnetic field pattern, wherein the magnetic field pattern is arranged such that the angle between the imaginary line and the longitudinal direction is between −10 and 10 degrees.

9. The material according to claim 8, wherein the peaks of the magnetic pattern have a distribution forming a substantially constant magnetic field along a width of the magnetic pattern in a direction perpendicular to the imaginary line, and forming a strongly decreasing magnetic field outside the width of the magnetic pattern in the direction perpendicular to the imaginary line.

10. The material according to claim 9, wherein the width is at least 2 mm.

11. The material according to claim 1, wherein said at least one of the magnetisable portions is positioned not more than between 5 and 15% of the width of the material from a longitudinal edge of the packaging material, and wherein said at least one spot is arranged to hold the first magnetic mark.

12. The material according to claim 5, wherein a distance between an area of a preparation feature and its aligned magnetic field mark is at least 10 mm.

13. The material according to claim 7, defining a transversal direction being parallel to an imaginary axis of a roll when a web of the material is spooled, a longitudinal direction perpendicular to the transversal direction, and an imaginary line between a midpoint of the first peak and the second peak of the magnetic field pattern, wherein the magnetic field pattern is arranged such that the angle between the imaginary line and the longitudinal direction is about 0 degrees.

14. The material according to claim 9, wherein the width is at least 6 mm.

15. The material according to claim 1, wherein the magnetic field pattern comprising the first magnetic field peak having the first polarity and the second magnetic field peak having the second opposite polarity is a magnetic field pattern created by applying a permanent magnet to the first magnetic mark.

16. The material according to claim 1, wherein the magnetic field pattern comprising the first magnetic field peak having the first polarity and the second magnetic field peak having the second opposite polarity is a magnetic field pattern created by applying an electromagnet to the first magnetic mark.

* * * * *